US006620054B2

(12) United States Patent
Tseng

(10) Patent No.: US 6,620,054 B2
(45) Date of Patent: Sep. 16, 2003

(54) DYNAMIC BALANCE MECHANISM FOR A GOLF CLUB

(76) Inventor: Wen-Cheng Tseng, No. 27, Kung Chuan Rd., Tai-Shan Hsiang, Taipei Hsien (TW)

( * ) Notice: Subject to any disclaimer, the term of this patent is extended or adjusted under 35 U.S.C. 154(b) by 0 days.

(21) Appl. No.: 10/077,742

(22) Filed: Feb. 13, 2002

(65) Prior Publication Data

US 2003/0153398 A1 Aug. 14, 2003

(51) Int. Cl.[7] ..... A63B 53/02
(52) U.S. Cl. ..... 473/306; 473/309; 473/312
(58) Field of Search ..... 473/306–307, 473/309–312, 244, 246, 248, 239, 296, 298, 299

(56) References Cited

U.S. PATENT DOCUMENTS 6,039,659 A * 3/2000 Hamm ..... 473/306
6,089,991 A * 7/2000 Yeh ..... 473/305
6,514,154 B1 * 2/2003 Finn ..... 473/306

* cited by examiner

*Primary Examiner*—Stephen Blau
(74) *Attorney, Agent, or Firm*—Thorp Reed & Armstrong, LLP

(57) ABSTRACT

A dynamic balance mechanism includes an adjusting barrel adapted to be adjustably extending into the club head and having a portion of the shaft securely received inside the adjusting barrel. A rotation of the adjusting barrel adjusts the relative position between the club head and the shaft.

6 Claims, 3 Drawing Sheets

DYNAMIC BALANCE MECHANISM FOR A GOLF CLUB

BACKGROUND OF THE INVENTION

1. Field of the Invention

The present invention relates to a dynamic balance mechanism, and more particularly to a dynamic balance mechanism for a golf club. The dynamic balance mechanism has an adjusting barrel adjustably sandwiched between the shaft and the club head such that the relative position between the club head and the shaft of the golf club can be adjusted to reach a dynamic balance therebetween before being secured permanently together.

2. Description of Related Art

In manufacturing of a conventional golf club, the relative position between a club head and a shaft is very important to reach a dynamic balance. If the dynamic balance is not reached, the golf club tends to vibrate unstably during a swing and therefore it is difficult for a player to make the swing successfully.

In order to prevent the lack of balance problem, during manufacturing of the golf club, an appropriate spot on the shaft is marked. Later, when assembling the club head and the shaft together, the gravity center of the club head is aligned to the marked spot to anticipate a dynamic balance. The golf club is then tested on a machine to ensure that the dynamic balance has been reached.

However, the testing is for quality check only. If a golf club is found to have an unsuitable balance between a club and a shaft, the defective golf club cannot be adjusted and must be thrown away. Therefore, the present manufacturing system in relation to the dynamic balance is not efficient.

To overcome the shortcomings, the present invention intends to provide an improved golf club to mitigate or obviate the aforementioned problems.

SUMMARY OF THE INVENTION

The objective of the present invention is to provide a dynamic balance mechanism for a golf club such that the relative position between the club head and the shaft of the golf club can be adjusted to reach a dynamic balance therebetween before being secured permanently together. Therefore, quality of the golf club can be maintained without wastage.

To achieve the above objectives, a golf club has a club head with a neck extending from the club head and a shaft connected to the club head. A blind bore is defined in the neck. Female threads are formed on an inner surface defining the blind bore. The shaft has a connecting end, and a threaded hole is defined in the connecting end.

The dynamic balance adjusting mechanism of the present invention comprises an adjusting barrel connecting the shaft to the club head has a first end and a second end. Male threads are formed on an outer surface of the adjusting barrel to be threadingly received in the blind bore in the club head. The shaft extends into the adjusting barrel via the first end. A plug is received in the blind bore and threadingly connected with the shaft via the second end of the adjusting barrel to connect the shaft and the adjusting barrel together. Whereby the club head, the adjusting barrel and the plug are securely connected by glue, and before the glue solidifies, the adjusting barrel is released, whereafter a relative position of the club head and the shaft is able to be adjusted so as to reach a dynamic balance of the golf club. The relative position is able to be temporarily secured by tightly screwing the adjusting barrel relative to the club head so as to wait for the glue to solidify.

Other objects, advantages and novel features of the invention will become more apparent from the following detailed description when taken in conjunction with the accompanying drawings.

DETAILED DESCRIPTION OF THE PREFERRED EMBODIMENT

Figure 1:
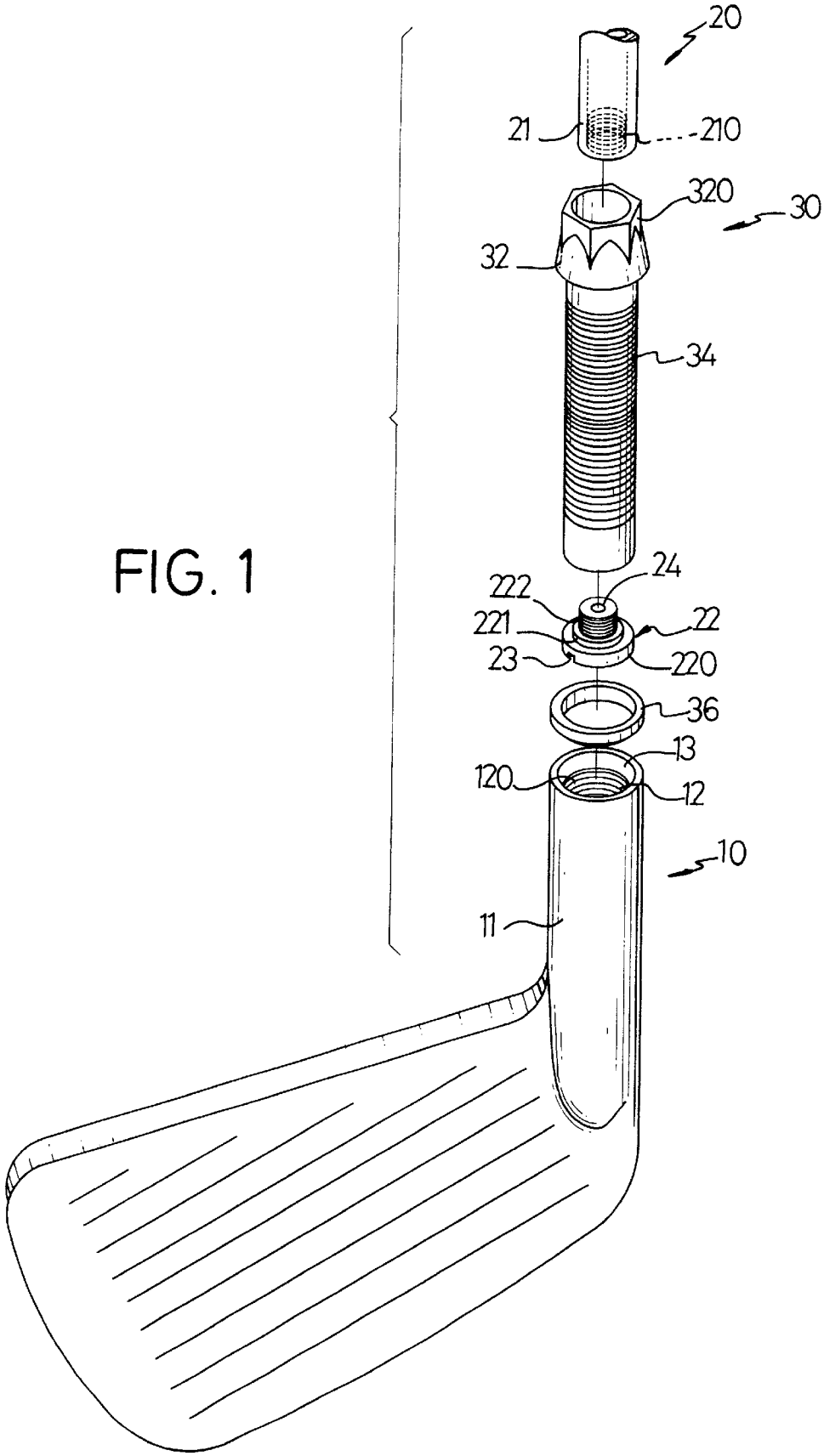
FIG. 1 is an exploded perspective view of a golf club and the dynamic balance mechanism in accordance with the present invention.

With reference to FIG. 1, a golf club includes a club head (10) and a shaft (20) connected to the club head (10). The dynamic balance mechanism in accordance with the present invention has a plug (22) and an adjusting barrel (30).

Figure 3:
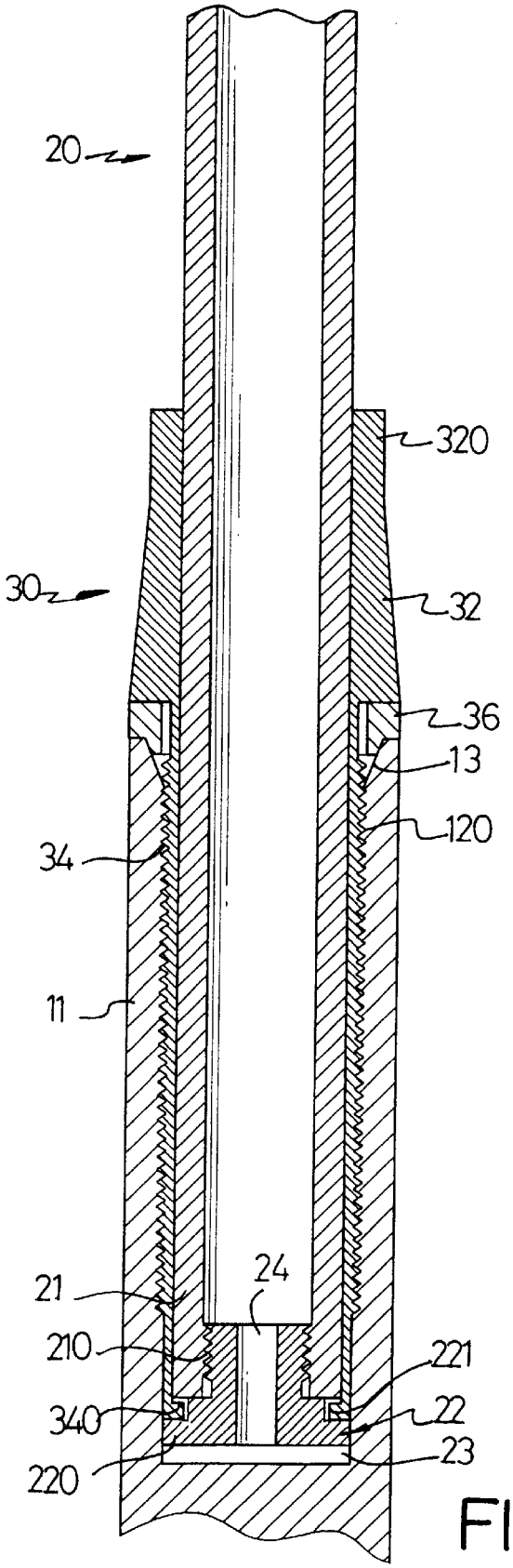
FIG. 3 is an enlarged cross sectional view in FIG. 2.

The club head has a neck (11) extending upwardly. A blind bore (12) is defined in the neck (11). A tapered opening (13), which more clearly shown in FIG. 3, is defined in a distal end of the neck (11) and communicates with the bore (12). Female threads (120) are formed on an inner surface defining the bore (12).

The shaft has a connecting end (21) to be connected with the plug (22). A threaded hole (210) is defined in the connecting end (21).

The plug (22) includes a base portion (220), a ring portion (221) and a threaded portion (222), wherein the ring portion (221) is integrally formed between the other two portions (220 and 222). More specifically, the plug (22) has a stepped appearance such that the base portion (220) has the largest diameter while the threaded portion (222) has the smallest diameter among these three portions (220, 221 and 222). A groove (23) is defined in a bottom surface of the base portion (220) and a through aperture (24) is defined in the plug (22) to extend from the threaded portion (222) to the base portion (220).

The adjusting barrel (30) has first and second open ends. Male threads (34) are formed on an outer surface of the adjusting barrel (30). An adjusting portion (32) is formed at the first open end of the adjusting barrel (30) and a polygonal periphery (320) is formed on an outer surface of the adjusting portion (32). As shown in FIG. 3, the second open end of the adjusting barrel (30) has a flange (340) inwardly formed, and the flange (340) is configured to have a thickness less than the height of the ring portion (221) of the plug (22). An elastic ring (36) is further provided to be mounted around the adjusting barrel (30) and abutting the adjusting portion (32).

Figure 2:
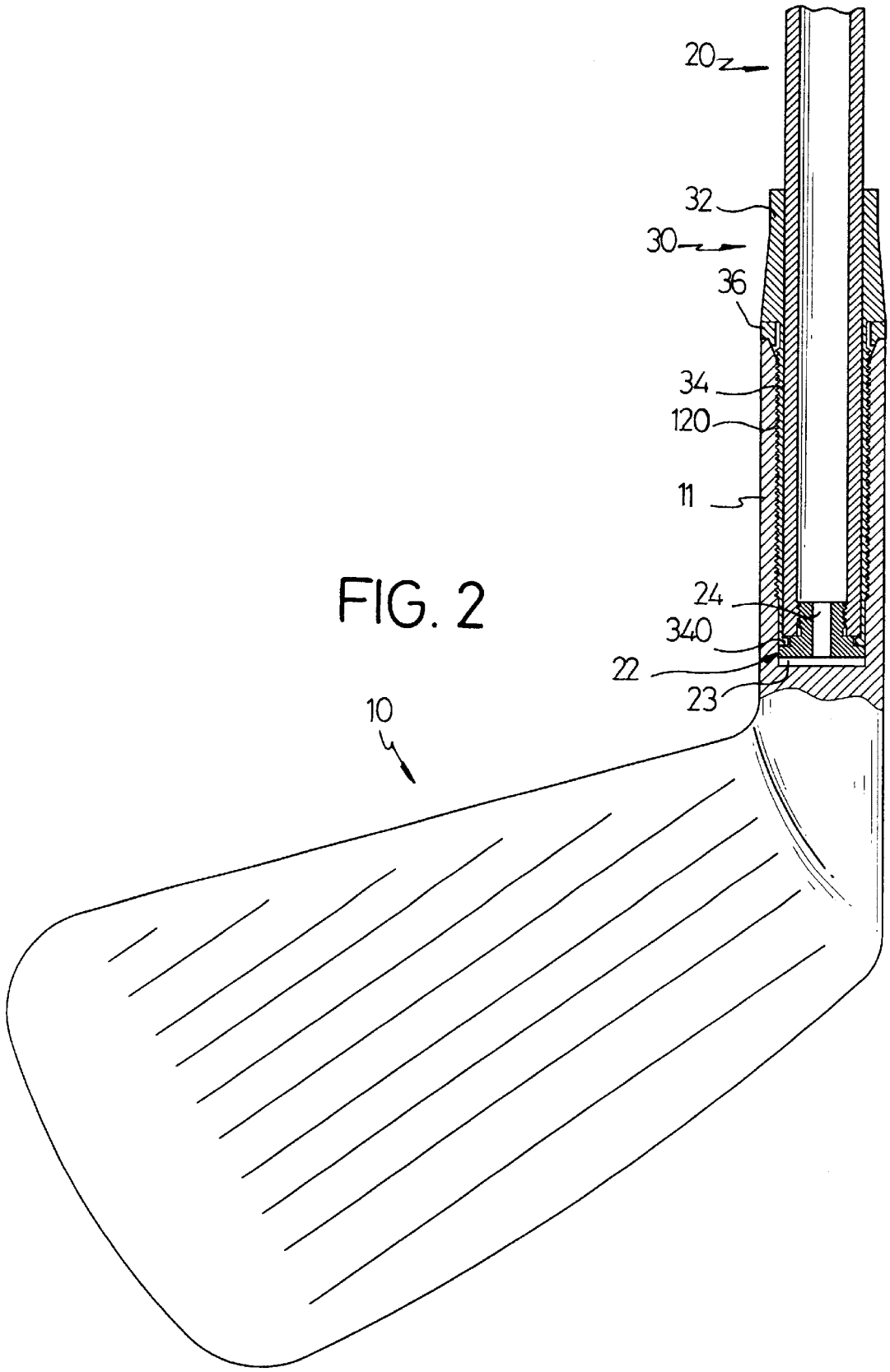
FIG. 2 is a side plan view with partial in section showing the relative position between the shaft and the club head after the adjusting barrel is inserted between the shaft and the club head.

With reference to FIGS. 2 and 3, in assembly of the golf club, glue is applied onto inner surfaces of the connecting end (21) and the adjusting barrel (30). Then, the connecting end (21) of the shaft (20) is inserted into the adjusting barrel (30) from the first open end to be temporarily abutted to an inner surface of the flange (340). The threaded portion (222) of the plug (22) is then tightly screwed into the threaded hole (210) via the second open end of the adjusting barrel (30). At this moment, the flange (340) locates and encompasses around the ring portion (221) and between a top surface of the base portion (220) and an outer surface of the connecting end (21). It is noted that due to the flange (340) being configured to have a height less than a height of the ring portion (221) of the plug (22), the adjusting barrel (30) can be rotated with respect to the plug (22) and the shaft (20). The elastic ring (36) is further mounted around the adjusting barrel (30) and abutting to the adjusting portion (32). After that, glue is also applied onto the outer surface of the adjusting barrel (30) and an inner surface defining the blind bore (12), and the adjusting barrel (30) is tightly screwed into the bore (12) so that the base portion (220) is pressed by the flange (340) to firmly engage a bottom surface defining the blind bore (12). Excess glue flows into the interior of the shaft (20) via the groove (23) and the aperture (24), and also flows into the tapered opening (13).

The golf club is immediately tested after assembly to see whether a dynamic balance has been reached between the club head (10) and the shaft (20). If not, the adjusting barrel (30) is slightly rotated and thus the relative position between the club head (10) and the shaft (20) is adjusted. It is noted that the screwing and unscrewing of the adjusting barrel (30) is made easy by gripping the polygonal periphery (320) by hand or with a tool. The adjusting and testing processes are performed repeatedly until the dynamic balance is actually reached. Finally, the glue solidifies and secures the club head (10), the shaft (20) and the adjusting barrel (30) permanently.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dynamic balance mechanism for a golf club having a club head with a neck and a shaft connected to the club head, the dynamic balance mechanism comprising:

an adjusting barrel adapted to be adjustably extending into the club head and having a portion of the shaft securely received inside the adjusting barrel, a plug received inside the adjusting barrel and adapted to be securely engaged with a distal end of the shaft, the plug having a through aperture defined to allow an outflow of glue flowing into the club head via the through aperture, whereby rotation of the adjusting barrel adjusts the relative position between the club head and the shaft.

2. The dynamic balance mechanism as claimed in claim 1, wherein the plug has a base portion, a ring portion and a threaded portion, wherein the ring portion is integrally formed between the base portion and the threaded portion.

3. The dynamic balance mechanism as claimed in claim 2, wherein the base portion has a largest diameter among the base, the ring and the threaded portions and the threaded portion has a smallest diameter among the base, the ring and the threaded portions.

4. The dynamic balance mechanism as claimed in claim 2, wherein the plug has a groove defined on a bottom surface of the base portion.

5. The golf club as claimed in claim 4 further comprising an elastic ring mounted around the adjusting portion of the adjusting barrel and adapted to be located between the adjusting barrel and the neck.

6. The dynamic balance mechanism as claimed in claim 1, wherein the adjusting barrel has an adjusting portion formed at a distal end of the adjusting barrel, the adjusting portion is configured to have a polygonal periphery to be gripped by a hand or a tool.

* * * * *